US012264896B2

(12) United States Patent
Pautler

(10) Patent No.: US 12,264,896 B2
(45) Date of Patent: Apr. 1, 2025

(54) ANALYSIS OF SKEET TARGET BREAKAGE

(71) Applicant: James Anthony Pautler, Plano, TX (US)

(72) Inventor: James Anthony Pautler, Plano, TX (US)

(73) Assignee: Take Aim Technologies IP LLC, Plano, TX (US)

( * ) Notice: Subject to any disclaimer, the term of this patent is extended or adjusted under 35 U.S.C. 154(b) by 571 days.

(21) Appl. No.: 17/257,243

(22) PCT Filed: Jun. 26, 2019

(86) PCT No.: PCT/US2019/039272

§ 371 (c)(1),
(2) Date: Dec. 30, 2020

(87) PCT Pub. No.: WO2020/006095

PCT Pub. Date: Jan. 2, 2020

(65) Prior Publication Data

US 2021/0270567 A1 Sep. 2, 2021

Related U.S. Application Data

(60) Provisional application No. 62/692,693, filed on Jun. 30, 2018.

(51) Int. Cl.
*F41G 1/473* (2006.01)
*F41A 33/00* (2006.01)
(Continued)

(52) U.S. Cl.
CPC ..... *F41G 1/473* (2013.01); *F41A 33/00* (2013.01); *F41G 3/26* (2013.01); *F41G 11/00* (2013.01)

(58) Field of Classification Search
CPC . F41G 1/473; F41G 3/26; F41G 11/00; F41G 1/54; F41G 3/142; F41G 3/2611;
(Continued)

(56) References Cited

U.S. PATENT DOCUMENTS 5,577,733 A * 11/1996 Downing ..... F41J 1/10 250/222.2
5,641,288 A 6/1997 Zaenglein, Jr.
(Continued)

FOREIGN PATENT DOCUMENTS

WO 2017145122 A1 8/2017

OTHER PUBLICATIONS

International Search Report issued in the corresponding International Application No. PCT/US19/39272, mailed on Sep. 18, 2019.
(Continued)

*Primary Examiner* — Robert P Bullington
*Assistant Examiner* — Stephen Alvesteffer

(57) ABSTRACT

An example shot tracking system may perform receiving, by a shot analysis module, a shot recoil signal from a shot tracking device, obtaining, by the shot analysis module, a density of pellets at a clay target position and a pellet velocity, calculating, by the shot analysis module, a probability of the pellets striking the clay target based on the density of the pellets, computing, by the shot analysis module, a probability of a breakage of the clay target based on the pellet velocity and the probability of the pellets striking the clay target, and providing the probability of breakage to a display device to be rendered to a user.

11 Claims, 5 Drawing Sheets

(51) Int. Cl.
*F41G 3/26* (2006.01)
*F41G 11/00* (2006.01)

(58) Field of Classification Search
CPC .... F41G 3/323; F41A 33/00; F41J 5/12; F41J 5/14
USPC ..... 434/19
See application file for complete search history.

(56) References Cited

U.S. PATENT DOCUMENTS

| | | | | |
|---|---|---|---|---|
| 2007/0044364 | A1* | 3/2007 | Sammut | F41G 1/38 42/122 |
| 2009/0217565 | A1* | 9/2009 | Ford | F41A 17/08 42/114 |
| 2010/0201620 | A1* | 8/2010 | Sargent | F41A 33/00 345/158 |
| 2013/0169820 | A1 | 7/2013 | Stewart | |
| 2017/0307333 | A1* | 10/2017 | Northrup | F41G 3/26 |

OTHER PUBLICATIONS

Written Opinion issued in the corresponding International Application No. PCT/US19/39272, mailed on Sep. 18, 2019.

* cited by examiner

ANALYSIS OF SKEET TARGET BREAKAGE

BACKGROUND OF THE INVENTION

1. Field of the Invention

Methods and apparatuses consistent with the present application relate to shooting sports. More particularly, the present application relates to calculation of probability of breakage of moving targets used in skeet shooting.

2. Description of the Related Art

There are many shooting sports that involve moving targets, including bird hunting, skeet, and trap. Shooting at moving targets requires the shooter to lead the target for a proper hit. The proper target lead may depend on many factors, including, but not limited to, target speed, target direction, target range, initial shot velocity, and the ballistics of the shot and target. Shooters typically learn proper target lead through a process of trial and error. The input to this learning process after each shot is either a hit result or a miss result. Unfortunately, many beginners to skeet shooting are unable to hit a single target after dozens of shots. Receiving only miss results, the beginner is not able to begin a successful learning process. These frustrated beginners give up on the sport because they fail to establish a proper target lead. On the other end of the experience spectrum, advanced shooters almost always receive hit results. These shooters have a difficult time improving further since they are not able to differentiate between center hits, off-center hits and moderately off-center hits. As such, what is needed is a solution that overcomes these problems.

Accordingly, what is needed is an efficient method for tracking shoots and calculating a probability of clay target breakage and for displaying the analytics to a shooter.

SUMMARY OF THE INVENTION

Exemplary embodiments overcome the above disadvantages and other disadvantages not described above. The exemplary embodiments may include a method for tracking shots and calculating a probability of clay target breakage. This allows for displaying of shots' analytics to the shooters.

An example embodiment provides a method that includes one or more of receiving, by a shot analysis module, a shot recoil signal from a shot tracking device, obtaining, by the shot analysis module, a density of pellets at a clay target position and a pellet velocity, calculating, by the shot analysis module, a probability of the pellets striking the clay target based on the density of the pellets, computing, by the shot analysis module, a probability of breakage of the clay target based on the pellet velocity and the probability of the pellets striking the clay target, and providing the probability of breakage to a display device.

Another example embodiment may provide a system that includes a processor and memory, wherein the processor is configured to perform one or more of receive a shot recoil signal from a shot tracking device, obtain a density of pellets at a clay target position and a pellet velocity, calculate a probability of pellets striking the clay target based on the pellet density, compute a probability of a breakage of the clay target based on the pellet velocity and the probability of the pellets striking the clay target, and provide the probability of breakage to a display device.

A further example embodiment may provide a non-transitory computer readable medium comprising instructions, that when read by a processor, cause the processor to perform one or more of receiving a shot recoil signal from a shot tracking device, obtaining a density of pellets at a clay target position and a pellet velocity, calculating a probability of the pellets striking the clay target based on the pellet density, computing a probability of a breakage of the clay target based on the pellet velocity and the probability of the pellets striking the clay target, and providing the probability of breakage to a display device.

BRIEF DESCRIPTION OF THE DRAWINGS

The above and/or other aspects and advantages of the present invention will become apparent and more readily appreciated from the following description of the exemplary embodiments, taken in conjunction with the accompanying drawings of which.

DETAILED DESCRIPTION

Figure 1:
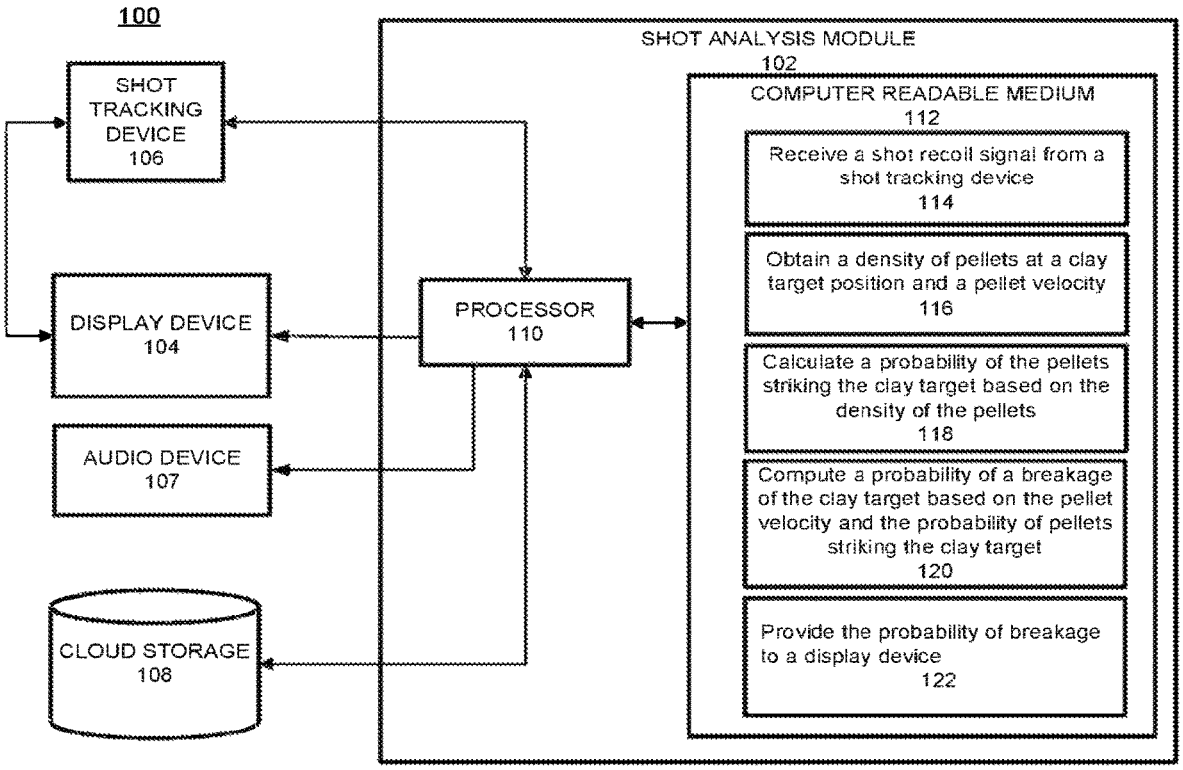
FIG. 1 illustrates a shot tracking system 100, according to an exemplary embodiment.

Reference will now be made in detail to exemplary embodiments of the present invention, examples of which are illustrated in the accompanying drawings.

It will be readily understood that the instant components, as generally described and illustrated in the figures herein, may be arranged and designed in a wide variety of different configurations. Thus, the following detailed description of the embodiments of at least one of a method, apparatus, non-transitory computer readable medium and system, as represented in the attached figures, is not intended to limit the scope of the application as claimed but is merely representative of selected embodiments.

The instant features, structures, or characteristics as described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

In one exemplary embodiment, a shot analysis module is provided. The shot analysis module device may show the relationship of where a clay target is relative to a position of a pellet shot stream as it passes by. This may help a user since the user can look at the information indicating where the clay target was in a position relative to the center of the pellet stream and relative to an outermost limit of the pellet stream. The exemplary embodiments provide enhanced information to the user including a probability of clay breakage based on a pellet spatial density and kinetic energy required to cause the clay to disintegrate upon impact of the pellets. On exemplary embodiment also provides the user with information as to where the "sweet spot" of the shot pattern is and how to correct the aim to hit the target on the next shot.

In one embodiment, an optical tracking device may be mountable on a shooting device. The optical tracking device may capture and analyze a target trajectory and may provide this information to the shot analysis module, which may present the shooter with a very accurate analysis of the hit or miss pattern. Modeling the detailed characteristics of the pellet shot stream as it impacts a clay target may be provided in one embodiment. This modeling involves the pellet density as it varies from a dense cloud of pellets in the center to a few spurious pellets at the edge of the pattern. From this information, the various probabilities of the number of pellets actually striking the clay target can be determined (via statistical computation, for example). Knowing this and the physical properties of the pellets, the kinetic energy of the impact may be determined. By combining this information with measured data of how much energy is required to break a clay target with a single pellet, two pellets and three or more pellets, a probability of an overall chance that the clay will actually break can be computed and displayed to the user.

Unlike a device that may determine a position of a day target in a shot pattern of a shotgun and provide information of where the clay target is relative to the extreme boundaries of the shot pattern, the exemplary embodiments provides information related to a probability that the clay target will actually break along with a number of pellets that likely hit the clay target.

According to one exemplary embodiment, the probability of clay breakage may be calculated as follows. Starting with the shot recoil detected, using an accelerometer with a threshold, the trajectory and position of the clay target and pellets are computed. This is accomplished by creating a 3D model and moving the target so that it will pass through the measured visual positions in the image of the moving camera by normal Newtonian mechanics including aerodynamic losses. Once the velocity at impact is known, the kinetic energy of the individual pellets can be computed. The spreading pattern of the pellets from the barrel may expand in an accelerated fashion depending on the choke used in the barrel of the shotgun. The pattern dimensions are known and may be computed here using measured pattern data versus distance of travel. The pattern density can be modeled at a two-dimensional normal distribution. This will yield a pellet density of pellets/inches-squared. A statistical analysis is then performed to compute the probability that 0, 1, 2, 3 or more pellets will hit the clay target of given physical size.

A laboratory setup that fired pellets at a clay target was used to empirically measure the distribution of clay break based on pellet energy by visually observing whether the clay broke while varying the number of pellets fired at controlled velocities. This is then used to compute the probability that the clay will break as a normal distribution of probability of break as a function of pellet kinetic energy. Combining all the individual event probabilities in an appropriate way will then yield the overall probability the clay will break. The equation for combining the probabilities is Pclay break=1−Prob of 0 pellets−(1−Prob of break given 1 pellet)*Prob of 1 pellet−(1−Prob of break given 2 pellets) *Prob of 2 pellets through all the combinations. This can then be displayed to the user. By re-computing the probability of clay breakage at various miss distances, the 90%, 50%, 5%, and 0.1% radii can be determined. These probability patterns can then be plotted on a visual display to show the "sweet spot" of the pellet pattern. After all of this, the overall process may be repeated. This will continue until the unit is shut off or commanded into another function.

FIG. 1 illustrates a shot tracking system 100, according to an exemplary embodiment. Referring to FIG. 1, there is an optical tracking device 106 that may be mounted to a shooting device (not shown). The tracking device 106 may be aligned to the shooting device so that it has knowledge of the axis and parallax offsets that must be corrected. This may be accomplished by first pointing the shooting device (e.g., shotgun manually) at an identifiable object roughly 10 to 30 yards away. The tracking device 106 may then take an image of the scene and display it to the user via a visual display device 104. The user may then touch and place a set of crosshairs on the object in the image. The user may also enter the estimated distance to the object along with the offset from the barrel so that the parallax can be computed. The tracking device 106 may acquire data related to the target and may present the data to a shot analysis module 102 for further computations. The shot analysis module 102 may provide the results to the visual display device 104 to provide a feedback to the user on how to improve his shooting accuracy. In one embodiment, the shot analysis module 102 may provide data to an audio device 107 (e.g., head phones). The display device 104 may be configured to provide a wireless Internet connection to the cloud storage 108 for storage and social media applications. The shot analysis module 102 may be connected to the cloud storage 108 as well.

While this example shows only one shot analysis module 102, multiple shot analysis modules may be connected to multiple shot tracking devices. It should be understood that the shot analysis module 102 may include additional components and that some of the components described herein may be removed and/or modified without departing from a scope of the shot analysis module 102 disclosed herein. The shot analysis module 102 may be a computing device or a server computer, or the like, and may include a processor 110, which may be a semiconductor-based microprocessor, a central processing unit (CPU), an application specific integrated circuit (ASIC), a field-programmable gate array (FPGA), and/or another hardware device. Although a single processor 110 is depicted, it should be understood that the shot analysis module 102 may include multiple processors, multiple cores, or the like, without departing from a scope of the shot analysis module 102.

According to one exemplary embodiment, the system 100 may include a rotation measuring device that may sample and store information on a rotating buffer where several seconds of data can be retrieved. In addition, a camera may be used for taking images (in one embodiment, continually taking images) and also storing the images in a rotating buffer where the last N photos can be retrieved. A shot detection is accomplished by measuring a recoil by using an accelerometer with a threshold crossing detector. The processor 110 may retrieve the contents of the rotation measurement and the image storage buffers. The processor 100 may then perform a trajectory analysis using setup information and the image and rotation data. This may be accomplished by creation of a 3D model and by moving the target so that it will pass through the measured visual positions in the image of the moving camera. The results of this process are then exported to the display device 104 via a wireless interface.

The shot analysis module 102 may also include a non-transitory computer readable medium 112 that may have stored thereon machine-readable instructions executable by the processor 110. Examples of the machine-readable instructions are shown as 114-122 and are further discussed below. Examples of the non-transitory computer readable medium 112 may include an electronic, magnetic, optical, or other physical storage device that contains or stores executable instructions. For example, the non-transitory computer readable medium 112 may be a Random Access Memory (RAM), an Electrically Erasable Programmable Read Only Memory (EEPROM), a hard disk, an optical disc, or other type of storage device.

The processor 110 may fetch, decode, and execute the machine-readable instructions 114 to receive a shot recoil signal from a shot tracking device. The processor 110 may fetch, decode, and execute the machine-readable instructions 116 to obtain a density of pellets at a clay target position and a pellet velocity. The processor 110 may fetch, decode, and execute the machine-readable instructions 118 to calculate a probability of the pellets striking the clay target based on the density of the pellets. The processor 110 may fetch, decode, and execute the machine-readable instructions 120 to compute a probability of a breakage of the clay target based on the pellet velocity and the probability of pellets striking the clay target. The processor 110 may fetch, decode, and execute the machine-readable instructions 122 to provide the probability of breakage to a display device 104.

Figure 2:
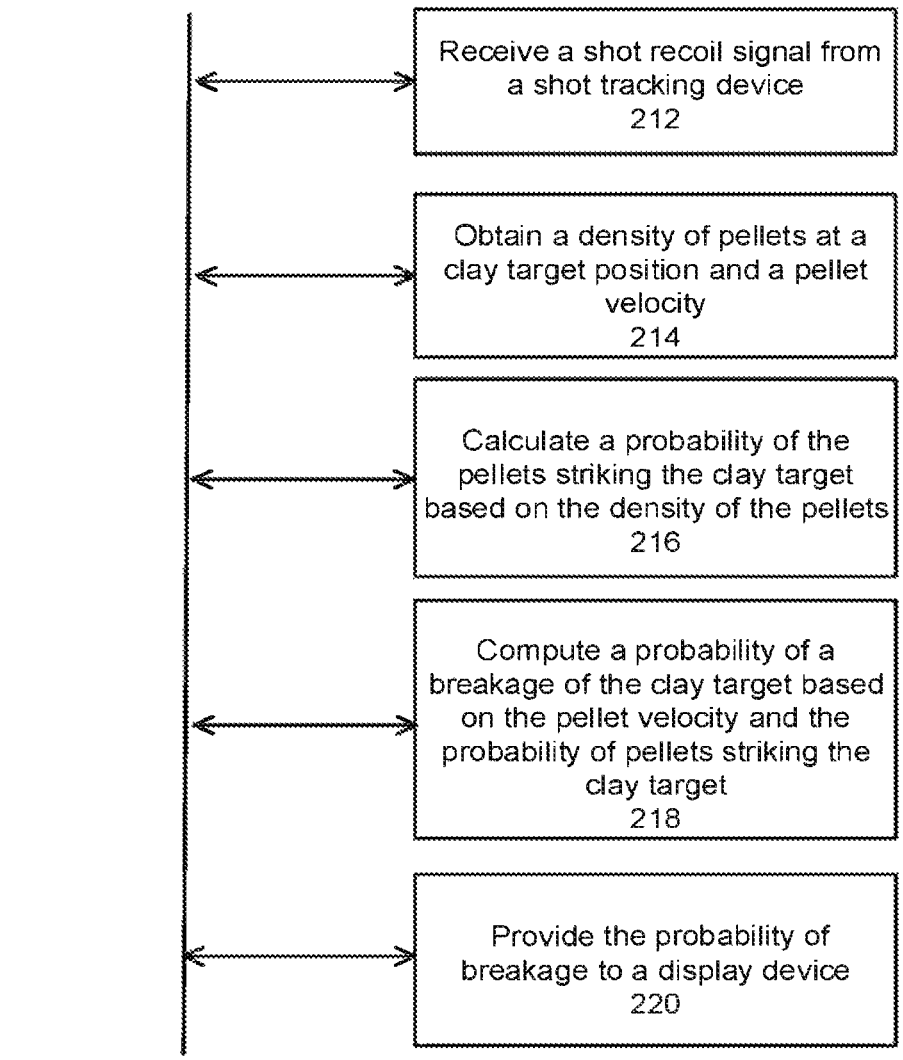
FIG. 2 illustrates a flow chart of an example method executed by the shot analysis module in accordance with one exemplary embodiment.

FIG. 2 illustrates a flow chart of an example method executed by the shot analysis module in accordance with one exemplary embodiment. It should be understood that method 200 depicted in FIG. 2 may include additional operations and that some of the operations described therein may be removed and/or modified without departing from the scope of the method 200. The description of the method 200 is made with reference to the features depicted in FIG. 1 for purposes of illustration. Particularly, the processor 110 of the shot analysis module 102 may execute some or all of the operations included in the method 200.

With reference to FIG. 2, at block 212, the processor 110 may receive a shot recoil signal from a shot tracking device. At block 214, the processor 110 may obtain a density of pellets at a clay target position and a pellet velocity. At block 216, the processor 110 may calculate a probability of the pellets striking the clay target based on the density of the pellets. At block 218, the processor 110 may compute a probability of a breakage of the clay target based on the pellet velocity and the probability of pellets striking the clay target. At block 220, the processor 110 may provide the probability of breakage to a display device. The probability of the breakage may be rendered to user on his mobile device in a form of circular graphs discussed below.

Figure 3:
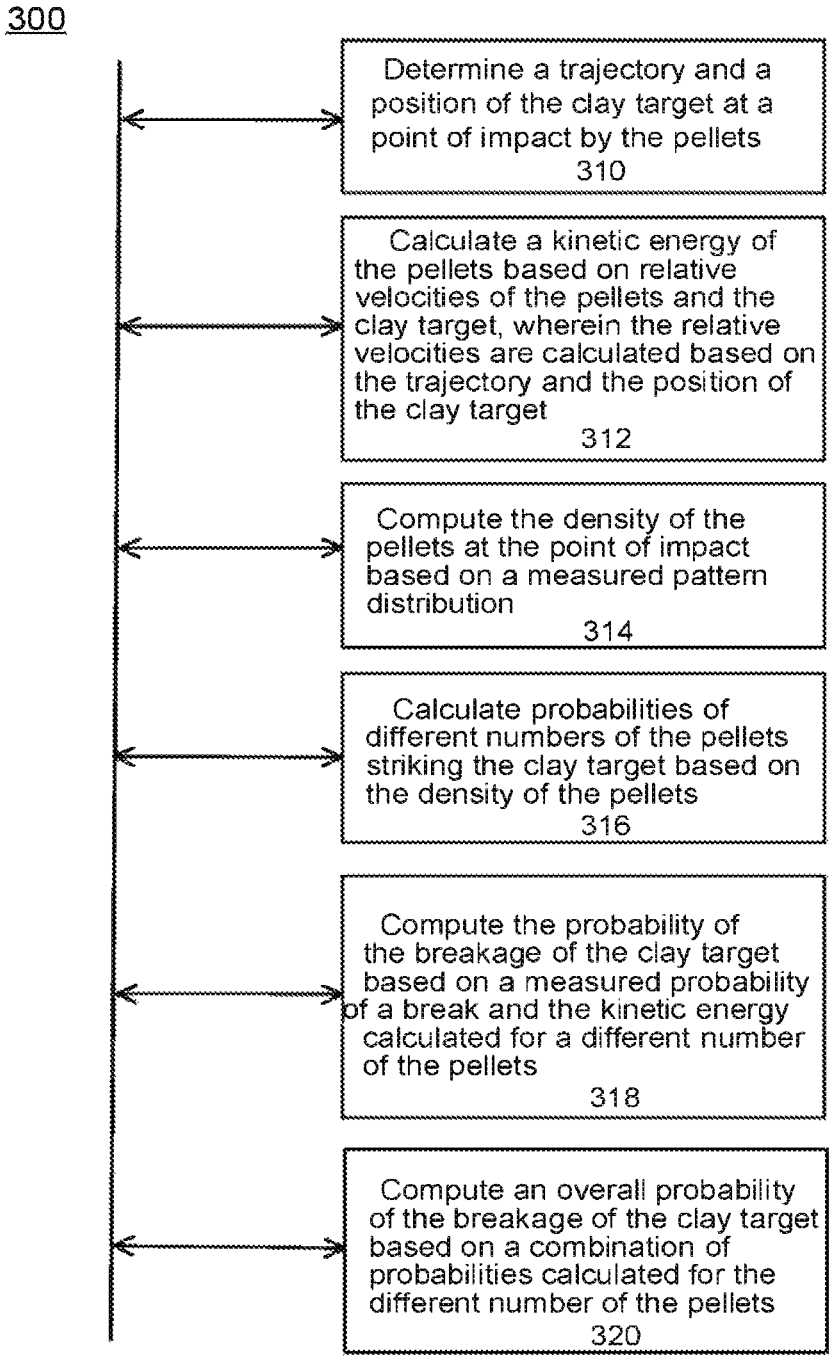
FIG. 3 illustrates a flow chart of an example method in accordance with one exemplary embodiment.

FIG. 3 illustrates a flow chart of an example method 300 executed by the shot analysis module 102 (see FIG. 1) in accordance with one exemplary embodiment. It should be understood that method 300 depicted in FIG. 3 may include additional operations and that some of the operations described therein may be removed and/or modified without departing from the scope of the method 300. The description of the method 300 is made with reference to the features depicted in FIG. 1 for purposes of illustration. Particularly, the processor 110 of the shot analysis module 102 may execute some or all of the operations included in the method 300.

With reference to FIG. 3, at block 310, the processor 110 may determine a trajectory and a position of the clay target at a point of impact by the pellets. At block 312, the processor 110 may calculate a kinetic energy of the pellets based on relative velocities of the pellets and the clay target, wherein the relative velocities are calculated based on the trajectory and the position of the clay target. At block 314, the processor 110 may compute the density of the pellets at the point of impact based on a measured pattern distribution. At block 316, the processor 110 may calculate probabilities of different numbers of the pellets striking the clay target based on the density of the pellets. At block 318, the processor 110 may compute the probability of the breakage of the clay target based on a measured probability of a break and the kinetic energy calculated for a different number of the pellets. At block 320, the processor 110 may compute an overall probability of the breakage of the clay target based on a combination of probabilities calculated for the different number of the pellets.

Figure 4:
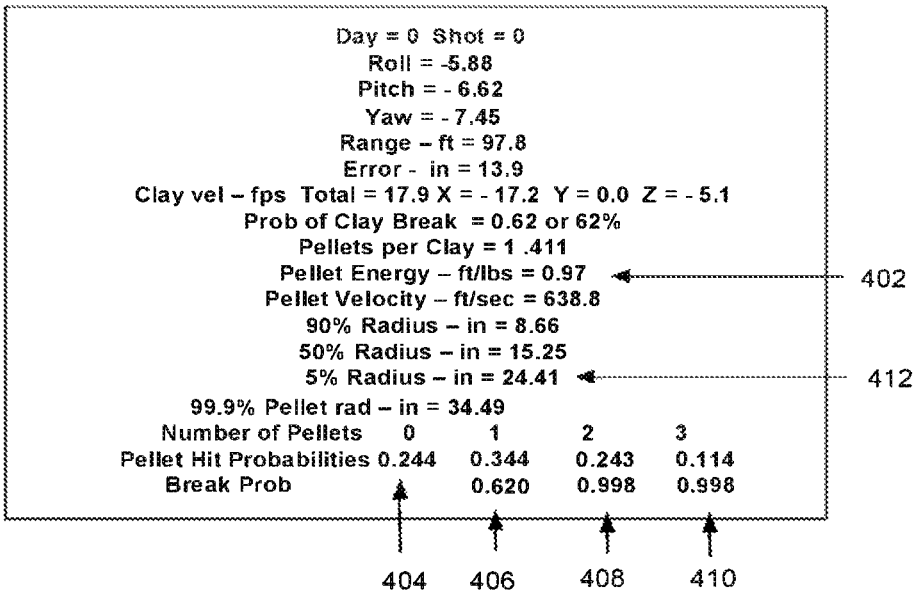
FIG. 4 illustrates how the pellet hit data is presented to the user via a visual display.

FIG. 4 illustrates how the pellet hit data is presented to the user via a visual display. The pellet kinetic energy 402 is displayed along with the various probabilities of pellet hit. First zero hits 404 is shown, followed by one hit and the probability of the clay breaking given one hit 406, two hits 408, and three or more hits 410. The various miss distances from the center of the pellet stream pattern are shown as radii 412.

Figure 5:
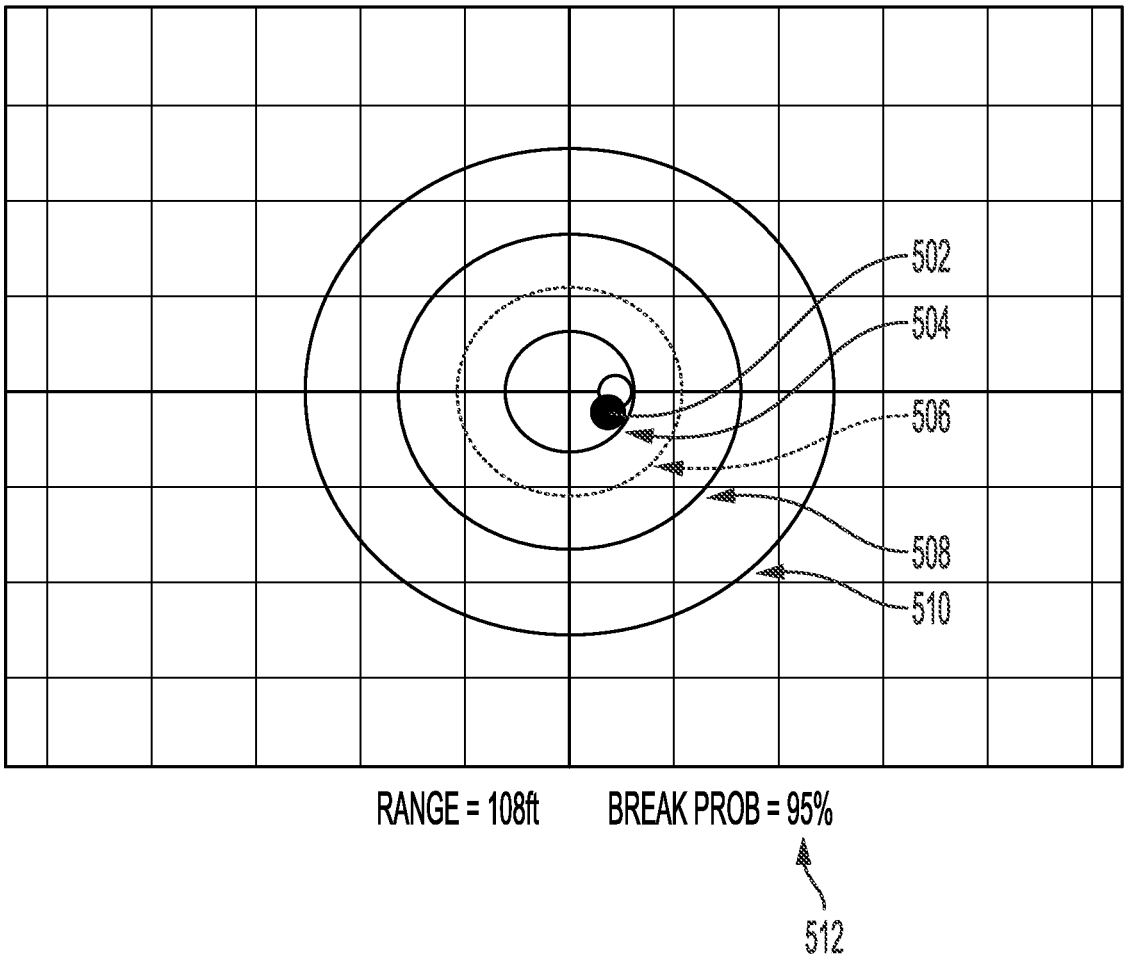
FIG. 5 illustrates a shot analysis that is produced after each shot.

FIG. 5 shows a shot analysis that is produced after each shot. The final position of the clay target 502 is displayed on a 1 ft×1 ft grid pattern. The 90% probability of clay break circle is shown in dark 504, the 50% break circle is shown as light circle 504, the 5% break circle as 506 and finally the 0.1% break circle is shown as 510. The overall clay target probability of breaking is shown in this case as 95%-512.

Although a few exemplary embodiments of the present invention have been shown and described, the present invention is not limited to the described exemplary embodiments. Instead, it would be understood by those skilled in the art that changes may be made to these exemplary embodiments without departing from the principles and spirit of the invention, the scope of which is defined by the claims and their equivalents.

What is claimed is:

1. A method, comprising:

capturing an image of a scene including an image of a clay target by a shot tracking device, wherein the shot tracking device is mounted on a shooting device;

storing the image in a memory by the shot tracking device;

detecting a recoil produced by a shot from the shooting device, wherein the shot fires a plurality of pellets;

generating a signal based on the recoil that was detected; and receiving by a shot analysis module the signal from the shot tracking device, wherein, in response to the signal, the shot analysis module further performs:

calculating a trajectory of the clay target by moving the image of the clay target through measured visual positions in the image of the scene using a three-dimensional (3D) model, identifying a position of impact of the plurality of pellets with the clay target based on the trajectory and a pattern of the plurality of pellets, calculating a density of the plurality of pellets at a position of impact with the clay target based on the 3D model, obtaining a velocity of the plurality of pellets at the position of impact with the clay target, calculating a kinetic energy of the plurality of pellets at the position of impact based on the velocity of the plurality of pellets and a velocity of the clay target, calculating a probability of one or more pellets of the plurality of pellets striking the clay target at the position of impact based on the density, generating a shot analysis comprising a plurality of probabilities of breaking the clay target based on the velocity of the plurality of pellets and the velocity of the clay target, and the probability of the one or more pellets striking the clay target within a plurality of different radii of the position of the clay target, and displaying via a display device a graphical representation of the plurality of different radii and corresponding probabilities of the plurality of probabilities.

2. The method according to claim 1, wherein the calculating of the density of the plurality of pellets further comprises:

calculating the density of the plurality of pellets at the position of impact based on the pattern of the plurality of pellets.

3. The method according to claim 1, wherein the calculating of the density of the plurality of pellets further comprises:

calculating a two-dimensional normal distribution of the plurality of pellets.

4. The method according to claim 1, further comprising:

calculating an overall probability of breakage of the clay target based on a combination of the plurality of probabilities.

5. A system, comprising:

a shooting device;

a shot tracking device affixed to the shooting device, wherein the shot tracking device is configured to capture an image of a scene including an image of a clay target, and store the image in a memory;

a shot analysis module comprising a processor that, when executing instructions stored in an associated memory, is configured to:

receive from the shot tracking device a signal generated based on a recoil of a shot from the shooting device, the shot firing a plurality of pellets, calculate a trajectory of the clay target by moving the image of the clay target through measured visual positions in the image of the scene using a three-dimensional (3D) model, identify a position of impact of the plurality of pellets with the clay target based on the trajectory and a pattern of the plurality of pellets, calculate a density of the plurality of pellets at a position of impact with the clay target based on the 3D model, obtain a velocity of the plurality of pellets at the position of impact with the clay target, calculate a kinetic energy of the plurality of pellets at the position of impact based on the velocity of the plurality of pellets and a velocity of the clay target, calculate a probability of one or more pellets of the plurality of pellets striking the clay target at the position of impact based on the density, generate a shot analysis comprising a plurality of probabilities of breaking the clay target based on the velocity of the plurality of pellets and the velocity of the clay target, and the probability of the one or more pellets striking the clay target within a plurality of different radii of the position of the clay target; and a display device configured to display a graphical representation of the plurality of different radii and corresponding probabilities of the plurality of different probabilities received from the shot analysis device.

6. The system according to claim 5, wherein when the processor calculates the density of the plurality of pellets, the processor is further configured to:

calculate the density of the plurality of pellets at the position of impact based on the pattern of the plurality of pellets.

7. The system according to claim 5, wherein when the processor calculates the density of the plurality of pellets, the processor is further configured to:

calculate a two-dimensional normal distribution of the plurality of pellets.

8. The system according to claim 5, wherein the processor is further configured to:

calculate an overall probability of a breakage of the clay target based on a combination of the plurality of probabilities.

9. A non-transitory computer-readable medium comprising instructions that, when executed by one or more processors, cause the one or more processors to perform:

capturing an image of a scene including an image of a clay target by a shot tracking device, wherein the shot tracking device is mounted on a shooting device;

storing the image in a memory by the shot tracking device;

detecting a recoil produced by a shot from the shooting device, wherein the shot fires a plurality of pellets;

generating a signal based on the recoil that was detected; and receiving by a shot analysis module the signal from the shot tracking device, wherein, in response to the signal, the instructions further cause the one or more processors to perform:

calculating a trajectory of the clay target by moving the image of the clay target through measured visual positions in the image of the scene using a three-dimensional (3D) model, identifying a position of impact of the plurality of pellets with the clay target based on the trajectory and a pattern of the plurality of pellets, calculating a density of the plurality of pellets at a position of impact with the clay target based on the 3D model, obtaining a velocity of the plurality of pellets at the position of impact with the clay target, calculating a kinetic energy of the plurality of pellets at the position of impact based on the velocity of the plurality of pellets and a velocity of the clay target, calculating a probability of one or more pellets of the plurality of pellets striking the clay target at the position of impact based on the density, generating a shot analysis comprising a plurality of probabilities of breaking the clay target based on the velocity of the plurality of pellets and, the velocity of the clay target, and the probability of the one or more pellets striking the clay target within a plurality of different radii of the position of the clay target, and displaying via a display device a graphical representation of the plurality of different radii and corresponding probabilities of the plurality of probabilities.

10. The non-transitory computer-readable medium of claim 9, wherein the calculating of the density of the plurality of pellets further comprises:

calculating the density of the plurality of pellets at the position of impact based on the pattern of the plurality of pellets.

11. The non-transitory computer-readable medium of claim 9, wherein the calculating of the density of the plurality of pellets further comprises: calculating a two-dimensional normal distribution of the plurality of pellets.

* * * * *